US008534420B1

(12) United States Patent
Michael

(10) Patent No.: US 8,534,420 B1
(45) Date of Patent: Sep. 17, 2013

(54) APPARATUS AND METHOD FOR SAFELY LOWERING USER FROM STRUCTURE

(71) Applicant: Ralph L. Michael, Lake Forest, CA (US)

(72) Inventor: Ralph L. Michael, Lake Forest, CA (US)

( * ) Notice: Subject to any disclaimer, the term of this patent is extended or adjusted under 35 U.S.C. 154(b) by 0 days.

(21) Appl. No.: 13/655,742

(22) Filed: Oct. 19, 2012

(51) Int. Cl.
*A62B 1/02* (2006.01)
*B66B 9/02* (2006.01)

(52) U.S. Cl.
USPC ..... 182/82; 182/141; 187/239

(58) Field of Classification Search
USPC ..... 182/82, 141; 187/239, 267
See application file for complete search history.

(56) References Cited

U.S. PATENT DOCUMENTS

| | | | | |
|---|---|---|---|---|
| 612,673 | A | 10/1898 | Reidy et al. | |
| 1,122,566 | A | 12/1914 | Bailey | |
| 3,946,989 | A | 3/1976 | Tsuda | |
| 4,437,546 | A | 3/1984 | Marinoff et al. | |
| 4,457,400 | A | 7/1984 | Donaldson et al. | |
| 4,480,716 | A | 11/1984 | Soubry et al. | |
| 4,487,292 | A | 12/1984 | Smith et al. | |
| 6,962,235 | B2 | 11/2005 | Leon | |
| 7,383,922 | B1 * | 6/2008 | Richey et al. | 187/267 |
| 2006/0096807 | A1 | 5/2006 | Lee | |
| 2008/0072837 | A1 * | 3/2008 | Redzisz et al. | 119/474 |

* cited by examiner

*Primary Examiner* — Alvin Chin Shue
(74) *Attorney, Agent, or Firm* — Fountain Law Group, Inc.; George L. Fountain

(57) ABSTRACT

An apparatus is disclosed for safely lowering a user from a structure. The apparatus includes a ring structure configured to coaxially surround a pole structure including a spiraling inclined surface, wherein the ring structure includes a circular track; a brake mechanism having a first portion configured to travel along the spiraling inclined surface and a second portion configured to travel along the circular track when the apparatus is descending; and a user support assembly for supporting a user when the apparatus is descending, wherein the user support assembly is securely attached to the ring structure. The user support assembly includes a seat or net securely coupled to a vertically-adjustable member which is, in turn, coupled to a fixed member by way of a ratchet interface. The apparatus also includes a torque limiting mechanism configured to prevent or reduce axial rotation of the ring structure when the apparatus is descending.

19 Claims, 3 Drawing Sheets

APPARATUS AND METHOD FOR SAFELY LOWERING USER FROM STRUCTURE

FIELD

This disclosure relates generally to emergency and safety devices, and in particular, to an apparatus and method for safely lowering a user from a structure, such as a building, house, bridge, equipment or other type of structures.

BACKGROUND

Residential and commercial buildings are often equipped with many safety features in order to deal with emergency situations. For instance, buildings often include smoke detectors and alarms adapted to alert people of an on-going fire to allow them to take safety measures, such as exiting a building in a safe manner. Additionally, many buildings include a network of fire extinguishers and fire-protected stairwells to protect those from harm due to fire and smoke. Often, these measures of alerting and protecting building dwellers are sufficient.

On occasion, a building may be damaged in such a way as to prevent the safe egress from the building. For example, the stairwell or exit corridor may be consumed with smoke or fire. Similarly, the exit path may be blocked due to earthquake damage. For people in a single story building or on the first or perhaps the second floor of a building, this may not be a problem because people may, to some degree, safely exit the structure through a window or door.

In situations that involve a multi-level or high-rise building, this situation of a blocked egress in the building may present a difficult or dire problem for the habitants. If, for example, some of those people are present at the lower seventh floors of a building, a fire truck ladder may be used to reach them, and bring them down in a safe manner. This is assuming that those people are able to wait out the emergency until a fire truck arrives. This may not always be the case.

In cases where building dwellers are above the seventh floor, other means, perhaps a rescue helicopter, may be needed to safely remove those inside the building. This may not always be possible, as in the case of the 9/11 New York City's twin tower disaster. Not only are the building dwellers susceptible to this kind of adverse situation, but fire fighters as well may get trapped in a multi-level building with no easy course-of-action to safely exit the structure. Thus, there is a need for an apparatus to facilitate a safe egress from a multi-level or high-rise building or structure.

SUMMARY

An aspect of the disclosure relates to an apparatus for safely lowering a user from a structure. The apparatus comprises a ring structure configured to coaxially surround a pole structure including a spiraling inclined surface, wherein the ring structure comprises a circular track. The apparatus further comprises a brake mechanism including a first portion configured to travel along the spiraling inclined surface and a second portion configured to travel along the circular track when the apparatus is descending. Additionally, the apparatus comprises a user support assembly for supporting a user when the apparatus is descending, wherein the user support assembly is securely coupled to the ring structure. The acceleration and braking forces are direct function of the weight of the mass being lowered (the apparatus including the user), the inclination angle of the spiraling inclined surface, and the coefficient of friction of the brake pad sliding on the spiraling inclined surface.

In another aspect of the disclosure, the first portion of the brake mechanism comprises a brake pad configured to frictionally slide along the spiraling inclined surface of the pole structure when the apparatus is descending. The brake mechanism may further comprises a roller bearing (one or more rollers) having a rotational axis substantially perpendicular to the plane of the inclined surface. The roller bearing is situated between the brake pad and a raised outer edge of the spiraling inclined surface. The roller bearing prevents the brake pad from slipping off the spiraling inclined surface due to centrifugal force. Additionally, the brake mechanism further comprises a pivot coupling between the brake pad and a rod coupling the first portion to the second portion. The pivot coupling allows the brake pad to pivot to accommodate different inclinations for the spiraling inclined surface. As an example, the inclination of the spiraling inclined surface may vary to control the rate of descent, such as to slow the rate of descent near ground or the landing zone.

In another aspect of the disclosure, the user support assembly comprises a seat or a net to support a user while the apparatus is descending. In another aspect, the user support assembly comprises a fixed member securely coupled to the ring structure, and a vertically-adjustable member coupled to the fixed member by way of a vertically-adjustable interface. In yet another aspect, the vertically-adjustable interface comprises a ratchet interface. In still another aspect, the user support assembly comprises one or more cranks configured to allow a user to adjust the ratchet interface to change a vertical position of the vertically-adjustable member with respect to the fixed member. In an additional aspect, the seat or net may be securely coupled to the vertically-adjustable member.

In still another aspect of the disclosure, the apparatus comprises a torque limiting mechanism configured to prevent or reduce axial rotation of the ring structure when the apparatus is descending. In yet another aspect, the torque limiting mechanism comprises an arm extending radially away from the ring structure, and a roller rotationally attached to an end portion of the arm, wherein the roller is configured roll vertically along a vertical fixed member of the structure when the apparatus is descending.

In yet another aspect of the disclosure, the ring structure comprises a hinge configured to pivotally separate a first portion from a second portion of the ring structure at a first angular location of the ring structure, and a lock configured to selectively lock the first and second portions together at a second angular location of the ring structure. In another aspect, the lock is configured to engage with an unlocking mechanism while the ring structure is descending near ground or a landing zone, wherein the unlocking mechanism is configured to unlock the lock to facilitate separation of the first portion from the second portion at the second angular location of the ring structure. This allows the ring structure to be removed from the pole structure.

Other aspects, advantages and novel features of the present disclosure will become apparent from the following detailed description of the disclosure when considered in conjunction with the accompanying drawings.

DETAILED DESCRIPTION OF THE EXEMPLARY EMBODIMENTS

Figure 1A:
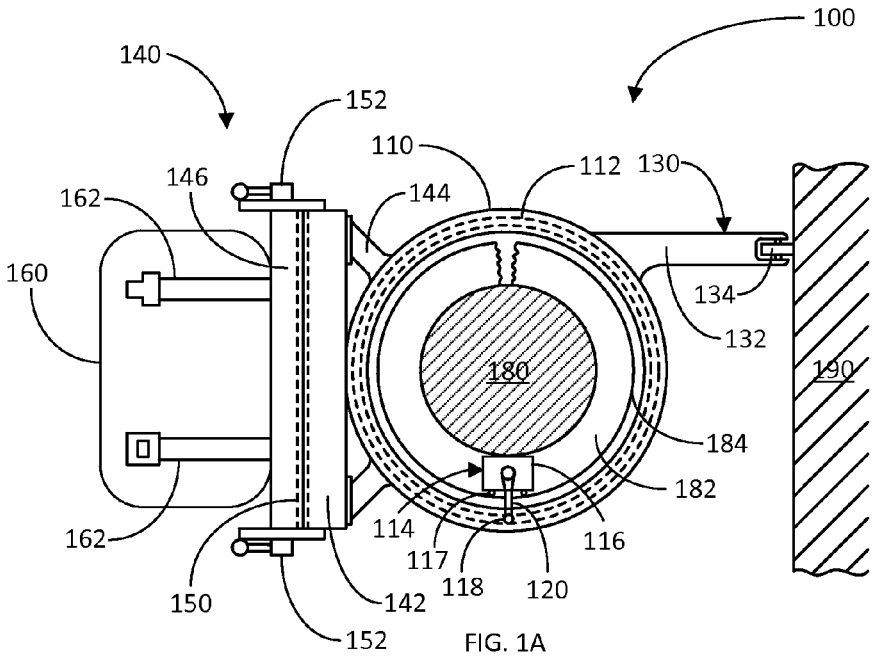
FIGS. 1A-1B illustrate top and side views of an exemplary apparatus for safely lowering a user from a structure in accordance with an aspect of the disclosure.
Figure 1B:
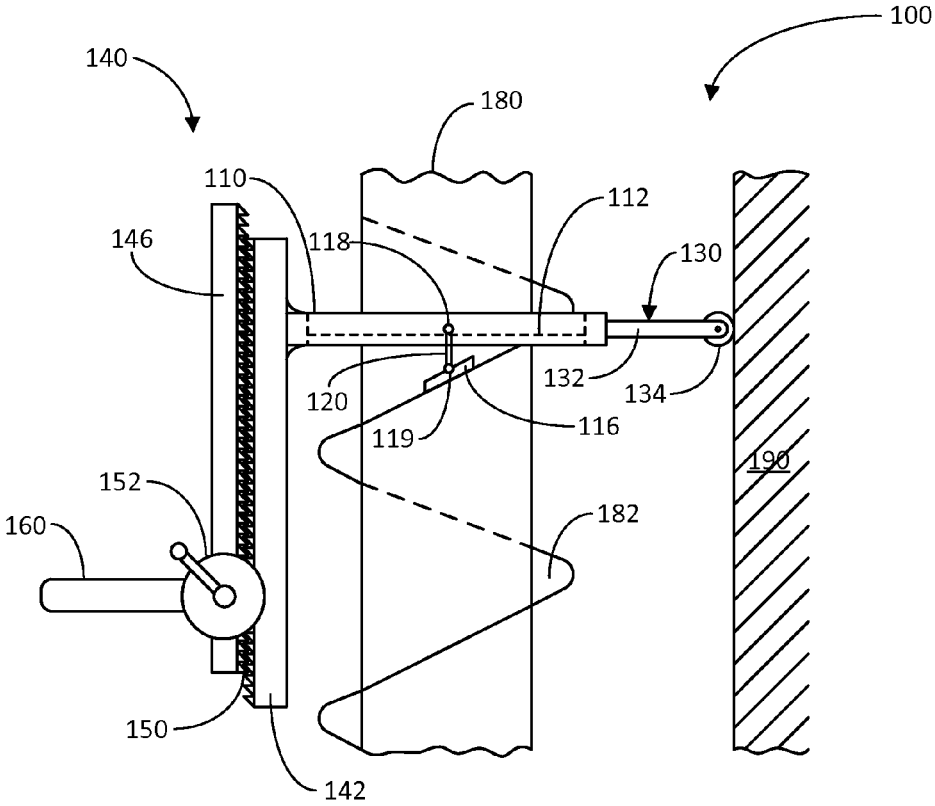

FIGS. 1A-1B illustrate top and side views of an exemplary apparatus 100 for safely lowering a user from a structure in accordance with an aspect of the disclosure. In summary, the apparatus 100 includes a rate-of-descent controlling device in the form of a ring structure or member configured to coaxially surround a pole structure with a spiraling inclined surface. The apparatus 100 also includes a brake mechanism configured to travel along the spiraling inclined surface and along a circular track incorporated into the ring structure. The apparatus 100 further includes a torque limiting mechanism to prevent rotation of the apparatus while it is descending. Additionally, the apparatus 100 further includes a user support assembly coupled to the ring structure for supporting a user during descent.

More specifically, with reference to FIG. 1, the apparatus 100 comprises a ring-shaped structure or member 110 that includes a circular track 112 incorporated therein. The ring structure 110 is configured to coaxially surround a pole structure 180 that includes a spiraling inclined surface 182. The pole structure 180 may be positioned proximate a structure 190, such as a building or housing, to allow a user to escape the structure using the apparatus 100.

The apparatus 100 further comprises a brake mechanism 114 that includes an upper portion 118, such as a ball-shaped structure, configured to travel or ride along the circular track 112 of the ring structure 110 as the apparatus 100 descends. An appropriate bearing may be provided to facilitate the movement of the upper portion 118 of the brake mechanism 114 along the track 112 of the ring structure 110. The brake mechanism 114 further comprises a brake pad 116 configured to frictionally slide along the spiraling inclined surface 182 of the pole structure 180 as the apparatus descends. The brake mechanism 114 further comprises a rod 120 to mechanically connect the upper portion 118 to the brake pad 116. The inclination of the spiraling inclined surface 182 and the friction encountered by the brake pad 116 as it slides along the surface 182 may be configured to provide a desired rate of descent for the apparatus.

The brake mechanism 114 further comprises a roller bearing 117 positioned between the brake pad and a raised outer edge 184 of the spiraling inclined surface 182. The roller bearing 117 may include one or more rollers having a rotational axis substantially perpendicular to the plane of the spiraling inclined surface 182 at the present location of the brake mechanism 114. The one or more rollers are configured to roll along the raised outer edge 184 of the spiraling inclined surface 182. The roller bearing 117 assists in preventing the brake pad 116 from slipping off the spiraling inclined surface 182 due to centrifugal force.

Additionally, the brake mechanism 114 comprises a pivot coupling 119 between the rod 120 and the brake pad 116. The pivot coupling 119 allows the brake pad 116 to pivot to maintain it substantially flat on the spiraling inclined surface 182 as the inclination of the surface 182 is changed. The inclination of the spiraling inclined surface 182 may change along the height of the pole structure 180 to control the rate of descent of the apparatus 100. For example, at a threshold height above ground or the landing zone, the inclination may be greater to cause the apparatus to descend relatively fast. Below the threshold height, the inclination may be less in order to slow down the descent of the apparatus near ground or the landing zone.

The apparatus 100 further comprises a torque limiting mechanism 130 configured to prevent rotation of the ring structure 110, or for that matter, the apparatus as it descends. That is, as the apparatus 100 descends, the brake mechanism 114 as it travels along the circular track 112 in a clockwise direction as seen from the top view of FIG. 1A, exerts a torque on the ring structure 110 which would otherwise cause it to rotate in the same clockwise direction. To prevent this rotation, the torque limiting mechanism 130 comprises an arm 132 that extends outward from the ring structure 110 and substantially perpendicular towards a wall or vertical member of the structure 190. The torque limiting mechanism 130 further includes a roller 134 at an end portion of the arm 132. The roller 134 is configured to rotate about a substantially horizontal axis, and is configured to roll along the wall or vertical member of the structure 190 as the apparatus descends. The abutment of the roller 134 against the wall or vertical member of the structure 190 counters the torque created by the brake mechanism 114 to prevent the apparatus 100 from rotating as it descends.

The apparatus 100 further comprises a user support assembly 140 for securely supporting a user, while the user and the apparatus descend to ground or a safe landing zone. The user support assembly 140 comprises a fixed member 142 that is securely coupled or attached to the ring structure 110 by one or more braces 144. The user support assembly 140 further comprises a vertically-adjustable member 146 coupled to the fixed member 142 by way of a ratchet interface 150. The apparatus 100 further comprises one or more cranks 152 to allow a user to adjust the vertical position of the vertically-adjustable member 146 with respect to the fixed member 142. The user support assembly 140 further comprises a seat 160 securely attached to the vertically-adjustable member 146. In this configuration, the user adjusts the vertical position of the seat 160 by way of the one or more cranks 152 and the ratchet interface 150, so when the apparatus 100 descends to its lowest position, the seat 160 lies above ground or the landing zone at an appropriate distance based on the height of the user. The user support assembly 140 may further comprise a seat belt 162 to securely maintain the user on the seat 160 while the apparatus 100 descends.

Figure 2A:
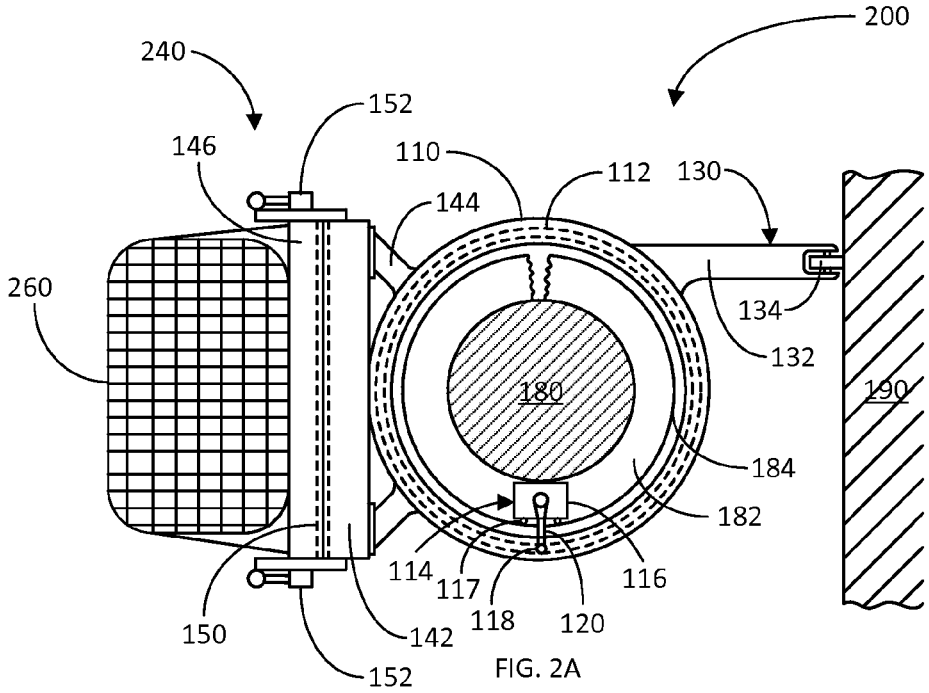
FIGS. 2A-2B illustrate top and side views of another exemplary apparatus for safely lowering a user from a structure in accordance with another aspect of the disclosure.
Figure 2B:
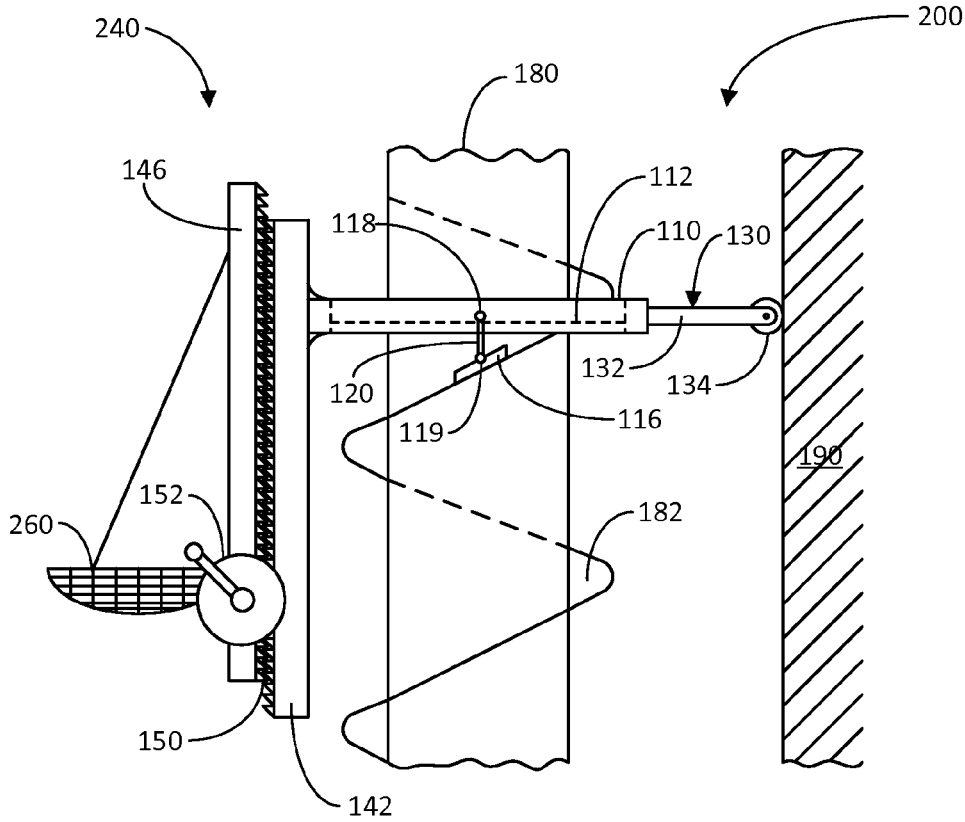

FIGS. 2A-2B illustrate top and side views of another exemplary apparatus 200 for safely lowering a user from the structure 190 in accordance with another aspect of the disclosure. The apparatus 200 is similar to the previous embodiment 100, and includes many of the same elements as indicated by the same reference numbers. The apparatus 200 differs from apparatus 100 in that it comprises a user support assembly 240 that includes a net 260 instead of a seat 160. The net 260 is securely attached to the vertically-adjustable member 146 of the user support assembly 240. It shall be understood that other types of user support structures may be used, such as a harness or a step.

Figure 3A:
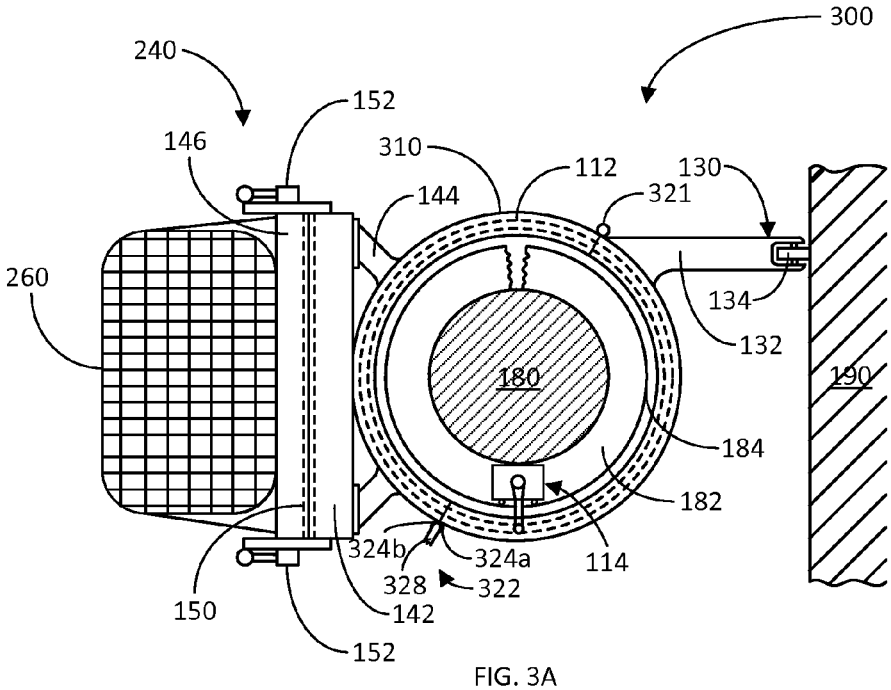
FIGS. 3A-3B illustrate top and side views of still another exemplary apparatus for safely lowering a user from a structure in accordance with another aspect of the disclosure.
Figure 3B:
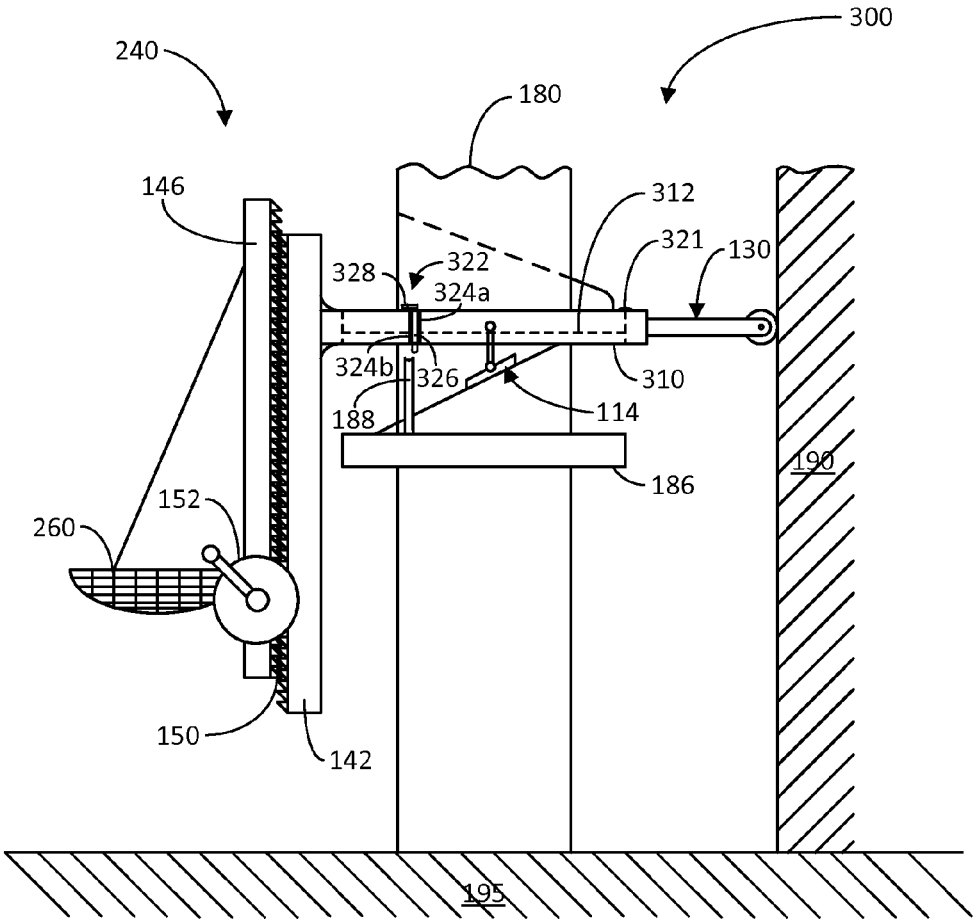

FIGS. 3A-3B illustrate top and side views of still another exemplary apparatus 300 for safely lowering a user from the structure 190 in accordance with another aspect of the disclosure. The apparatus 300 is similar to the previous embodiments 100 and 200, and includes many of the same elements as indicated by the same reference numbers. The apparatus 300 differs from apparatuses 100 and 200 in that it comprises a ring structure 310 that opens to allow the apparatus 300 to be removed from the pole structure 180 when the user reaches ground or the landing zone.

In particular, the ring structure 310 comprises a hinge 321 located along an outer surface of the ring structure at a first angular location. The hinge 321 pivots about a substantially vertical axis, and allows the ring structure to pivotally separate at the first angular location. The ring structure 310 also comprises a lock 322 located along the outer surface of the ring structure at a second angular location. The angular spacing between the first and second angular locations may be substantially 180 degrees. However, it shall be understood that other angular spacing between the hinge 321 and the lock 322 may be provided. The lock 322 securely holds two halves or sides of the ring structure 310 at the second angular location.

The lock 322, in turn, comprises an upper bore 324*a* securely attached to one of the halves or sides of the ring structure 310; for example, securely attached to the lower-right half or side of the ring structure 310 as seen from the top view depicted in FIG. 3A. The lock 322 further comprises a lower bore 324*b* securely attached to the other one of the halves or sides of the ring structure 310; for example, securely attached to the upper-left half or side of the ring structure 310 as seen from the top view depicted in FIG. 3A. The lock 322 further comprises a pin that includes a lower portion 326 situated axially within the upper and lower bores 324*a* and 324*b* when the ring structure 310 is closed and locked, and an upper portion 328 configured as a lip extending horizontally and radially away from the ring structure 310. The upper and lower bores 324*a* and 324*b* and the lower portion 326 of the pin may include substantially the same non-circular cross section in order to fix the orientation of the lip 328 of the pin.

Near ground level or the landing zone 195, a stop 184 is provided to prevent the ring structure 310 from descending beyond the stop. The stop 184 may be securely attached to the pole structure 180 as shown, may be securely attached to the structure 190, or may be securely attached to ground or the landing zone 195. The stop 184 further comprises an unlocking structure 186 extending vertically upwards from the stop. The top of the unlocking structure 186 is configured to engage the lip 328 of the pin as the ring structure 310 descends to that height, and completely remove the lower portion 326 of the pin from the upper and lower bores 324*a* and 324*b* by the time the ring structure descends to the top of the stop 184. This unlocks the ring structure 310, allowing it to be opened and be removed from the pole structure 180.

While the invention has been described in connection with various embodiments, it will be understood that the invention is capable of further modifications. This application is intended to cover any variations, uses or adaptation of the invention following, in general, the principles of the invention, and including such departures from the present disclosure as come within the known and customary practice within the art to which the invention pertains.

What is claimed is:

1. An apparatus for safely lowering a user from a structure, comprising:

a ring structure configured to coaxially surround a pole structure including a spiraling inclined surface, wherein the ring structure comprises a circular track;

a brake mechanism comprising a first portion configured to travel along the spiraling inclined surface and a second portion configured to travel along the circular track when the apparatus is descending, wherein the first portion of the brake mechanism comprises a brake pad configured to frictionally slide along the spiraling inclined surface of the pole structure when the apparatus is descending; and a user support assembly for supporting a user when the apparatus is descending, wherein the user support assembly is securely coupled to the ring structure.

2. The apparatus of claim 1, wherein the brake mechanism further comprises roller bearing situated between the brake pad and a raised edge of the spiraling inclined surface.

3. The apparatus of claim 1, wherein the brake mechanism further comprises a rod coupling the first portion to the second portion, wherein the rod is pivotally coupled to the second portion to allow the brake pad to lie substantially flat on the spiraling inclined surface for varying inclinations of the spiraling inclined surface.

4. The apparatus of claim 1, wherein the user support assembly comprises a seat to support a user while the apparatus is descending.

5. The apparatus of claim 4, wherein the user support assembly comprises a seat belt to maintain the user securely on the seat while the apparatus is descending.

6. The apparatus of claim 1, wherein the user support assembly comprises a net to support a user while the apparatus is descending.

7. The apparatus of claim 1, wherein the user support assembly comprises:

a fixed member securely coupled to the ring structure; and a vertically-adjustable member coupled to the fixed member by way of a vertically-adjustable interface.

8. The apparatus of claim 7, wherein the user support assembly comprises a net securely attached to the vertically-adjustable member.

9. The apparatus of claim 1, further comprising a torque limiting mechanism configured to prevent or reduce axial rotation of the ring structure when the apparatus is descending.

10. An apparatus for safely lowering a user from a structure, comprising:

a ring structure configured to coaxially surround a pole structure including a spiraling inclined surface, wherein the ring structure comprises a circular track;

a brake mechanism comprising a first portion configured to travel along the spiraling inclined surface and a second portion configured to travel along the circular track when the apparatus is descending; and a user support assembly for supporting a user when the apparatus is descending, wherein the user support assembly is securely coupled to the ring structure, wherein the user support assembly comprises:

a fixed member securely coupled to the ring structure; and a vertically-adjustable member coupled to the fixed member by way of a vertically-adjustable interface, wherein the vertically-adjustable interface comprises a ratchet interface.

11. The apparatus of claim 10, wherein the user support assembly comprises one or more cranks configured to allow a user to adjust the ratchet interface to change a vertical position of the vertically-adjustable member with respect to the fixed member.

12. An apparatus for safely lowering a user from a structure, comprising:

a ring structure configured to coaxially surround a pole structure including a spiraling inclined surface, wherein the ring structure comprises a circular track;

a brake mechanism comprising a first portion configured to travel along the spiraling inclined surface and a second portion configured to travel along the circular track when the apparatus is descending;

a user support assembly for supporting a user when the apparatus is descending, wherein the user support assembly is securely coupled to the ring structure; and a torque limiting mechanism configured to prevent or reduce axial rotation of the ring structure when the apparatus is descending, wherein the torque limiting mechanism comprises:

an arm extending outward from the ring structure; and a roller rotationally attached to an end portion of the arm, wherein the roller is configured roll vertically along a vertical fixed member of the structure when the apparatus is descending.

13. An apparatus for safely lowering a user from a structure, comprising:

a ring structure configured to coaxially surround a pole structure including a spiraling inclined surface, wherein the ring structure comprises a circular track, wherein the ring structure comprises:

a hinge configured to pivotally separate a first portion from a second portion of the ring structure at a first angular location of the ring structure; and a lock configured to selectively lock the first and second portions together at a second angular location of the ring structure;

a brake mechanism comprising a first portion configured to travel along the spiraling inclined surface and a second portion configured to travel along the circular track when the apparatus is descending; and a user support assembly for supporting a user when the apparatus is descending, wherein the user support assembly is securely coupled to the ring structure.

14. The apparatus of claim 13, wherein the lock is configured to engage with an unlocking mechanism while the ring structure is descending near a landing zone, wherein the unlocking mechanism is configured to unlock the lock to facilitate the separation of the first portion from the second portion at the second angular location of the ring structure.

15. An apparatus for safely lowering a user from a structure, comprising:

a pole structure comprising a spiraling inclined surface;

a ring structure configured to coaxially surround the pole structure, wherein the ring structure comprises a circular track;

a brake mechanism comprising a first portion configured to travel along the spiraling inclined surface and a second portion configured to travel along the circular track when the apparatus is descending, wherein the first portion of the brake mechanism comprises a brake pad configured to frictionally slide along the spiraling inclined surface of the pole structure when the apparatus is descending; and a user support assembly for supporting a user when the apparatus is descending, wherein the user support assembly is securely coupled to the ring structure.

16. The apparatus of claim 15, wherein the user support assembly comprises:

a fixed member securely coupled to the ring structure; and a vertically-adjustable member coupled to the fixed member by way of a vertically-adjustable interface.

17. The apparatus of claim 16, wherein the user support assembly comprises a net to support a user while the apparatus is descending, wherein the net is securely coupled to the vertically-adjustable member.

18. An apparatus for safely lowering a user from a structure, comprising:

a pole structure comprising a spiraling inclined surface;

a ring structure configured to coaxially surround the pole structure, wherein the ring structure comprises a circular track, wherein the ring structure comprises:

a hinge configured to pivotally separate a first portion from a second portion of the ring structure at a first angular location of the ring structure; and a lock configured to selectively lock the first and second portions together at a second angular location of the ring structure;

a brake mechanism comprising a first portion configured to travel along the spiraling inclined surface and a second portion configured to travel along the circular track when the apparatus is descending; and a user support assembly for supporting a user when the apparatus is descending, wherein the user support assembly is securely coupled to the ring structure.

19. The apparatus of claim 18, wherein the lock is configured to engage with an unlocking mechanism while the ring structure is descending near a landing zone, wherein the unlocking mechanism is configured to unlock the lock to facilitate the separation of the first portion from the second portion at the second angular location of the ring structure.

* * * * *